US005554995A

United States Patent [19]

Jun

[11] Patent Number: 5,554,995

[45] Date of Patent: Sep. 10, 1996

[54] FLAT ANTENNA OF A DUAL FEEDING TYPE

[75] Inventor: Joo S. Jun, Seoul, Rep. of Korea

[73] Assignee: Goldstar Co., Ltd., Seoul, Rep. of Korea

[21] Appl. No.: 240,203

[22] Filed: May 9, 1994

Related U.S. Application Data

[63] Continuation of Ser. No. 945,063, Sep. 15, 1992, abandoned.

[30] Foreign Application Priority Data

Sep. 16, 1991 [KR] Rep. of Korea ..... 1991-16144

[51] Int. Cl.[6] ..... H01Q 1/38; H01Q 21/22

[52] U.S. Cl. ..... 343/700 MS; 343/846; 343/853

[58] Field of Search ..... 343/700 MS, 846, 343/853, 857, 770

[56] References Cited

U.S. PATENT DOCUMENTS

| | | | |
|---|---|---|---|
| 5,005,019 | 4/1991 | Zaghloul | 343/700 MS |
| 5,181,042 | 1/1993 | Kaise et al. | 343/700 MS |
| 5,187,490 | 2/1993 | Ohta et al. | 343/700 MS |
| 5,278,569 | 1/1994 | Ohta et al. | 343/700 MS |
| 5,287,116 | 2/1994 | Iwasaki et al. | 343/700 MS |

FOREIGN PATENT DOCUMENTS 62-289002 12/1987 Japan .

*Primary Examiner*—Hoanganh Le
*Attorney, Agent, or Firm*—Spencer & Frank

[57] ABSTRACT

A flat antenna comprising a ground substrate, a first insulating substrate formed on the ground substrate for electrical isolation, a feeding network substrate formed on the first insulating substrate, a second insulating substrate formed on the feeding network substrate for removal of a signal coupling, and a radiation element substrate formed on the second insulating substrate, wherein the ground substrate and the feeding network substrate are electrically isolated from each other by the first insulating substrate and the signal coupling between the feeding network substrate and the radiation element substrate are removed by the second insulating substrate. Therefore, according to the present invention, the reception frequency characteristic can be widened and the antenna body in which a multiplicity of antenna units are integrated has the multi-layered structure to prevent an undesired radiation and to remove the signal coupling between the components, resulting in an increase in universalization and reliability of the whole reception characteristic of the antenna.

5 Claims, 7 Drawing Sheets

FLAT ANTENNA OF A DUAL FEEDING TYPE

This is a continuation of application Ser. No. 07/945,063,filed on Sep. 15, 1992, now abandoned.

BACKGROUND OF THE INVENTION

1. Field of the Invention

The present invention relates in general to a flat antenna, and more particularly to a flat antenna of the dual feeding type wherein a band width of a reception frequency can be widened and a reception efficiency can be increased.

2. Description of the Prior Art

The exchange of television programs is established between countries by interconnecting two positions far apart from each other on the earth with an electromagnetic wave by means of an artificial satellite with a transponder which is made up of a transmitter and & receiver, which is called a communication satellite. Development of the industrial technology is followed by the trend of miniaturation, lightness and thinness of products. According to such trend, there has actively been progressed the study of an antenna which is an equipment for transmission and reception of a broadcasting signal, particularly in a satellite broadcasting field.

A flat antenna is utilized as an antenna for a moving object such as satellite, airplane and the like or for reception of a satellite broadcasting signal over a frequency region from an ultra high frequency (UHF) band to a super high Frequency (SHF) band.

A typical form of an antenna for generating a circular polarization employing a micro strip antenna (MSA) for a linear polarization in the flat antennas For reception of the satellite broadcasting signal will be described hereinafter with reference to FIGS. 1 to 4. The flat antenna basically has a dielectric substrate and conductors formed on the opposite surfaces of the dielectric substrate. Namely, as shown in FIG. 1, the flat antenna comprises a dielectric substrate 1, a ground substrate 2 formed on the lower surface of the dielectric substrate 1 and a plurality of patch units (radiation elements) 3 of desired size formed on the upper surface of the dielectric substrate 1. Herein, the patch unit 3 has a length smaller than or equal to $\lambda g/2$ of a useful frequency of the flat antenna.

As shown in FIG. 2, the patch units 3 are connected to one another through transformers T1–T5 and feeding lines A0–A6, thereby resulting in a provision of a feeding network. In this drawing, there is shown an example of 4*4 array flat antenna.

The main feeding line A0 is branched out into the feeding lines A1 and A2 and the transformer T1 having a length of $\lambda g/4$ is provided for impedance matching at the branch point. The feeding line A1 is branched out into the feeding lines A3 and A4 and the transformer T2 having a length of $\lambda g/4$ is provided for impedance matching at the branch point. Also, the feeding line A3 is branched out into the feeding lines A5 and A8 and the transformer T3 having a length of $\lambda g/4$ is provided for impedance matching at the branch point. The remaining transformers T4 and T5 are provided in the same manner.

The patch units 3 constructed as mentioned above each has a diagonal slot 4 formed for the circular polarization as shown in FIG. 3, which is a detailed diagram of a portion H in FIG. 2. The diagonal slot 4 is arranged at an angle of ±45° with respect to the feeding line A. The space between center lines of the adjacent patch units 3 is 0.7–1.0$\lambda\alpha$. Assuming that a diagonal length of the diagonal slot 4 is 1 and a width thereof is wo, a reception level of the circular polarization is varied according to 1/wo.

Since a phase difference of 90° is present in orthogonal mode in the flat antenna as shown in FIG. 4, a right handed circular polarization is generated when the diagonal slot 4 of the patch unit 3 is arranged at an angle of +45° with respect to the feeding line A and a left handed circular polarization is generated when the diagonal slot 4 of the patch unit 3 is arranged at an angle of −45° with respect to the feeding line A. For the purpose of impedance matching with a transmission circuit, the transformers T1–T5 each has a value of Zin.Zo, where Zin and Zo are input and output impedances of the patch unit 3, respectively. In other words, the transformers T1–T5 each has a value of Zo/2 to provide a feeding power uniformly and several hundred or more patch units 3 may be provided in making the flat antenna.

In such planar antenna, there may be provided a multistage feeding network and electromagnetic waves radiated from the respective patch units 3 are entirely in phase in view of a far electromagnetic field. As a result, such flat antenna is utilized as a directional antenna with acuteness in a particular direction.

However, the conventional flat antenna has a disadvantage, in that a frequency characteristic thereof is provided as a narrow band as shown in FIG. 5 since the slot 4 of the patch unit 3 has a small axial ratio, resulting in a low flexibility in use. Particularly when the satellite broadcasting is to be performed between the first region of about 800 MHz and the third region of about 500 MHz, the reception of the widened band signal cannot be covered with the narrow frequency band. For this reason, the construction of the flat antenna for reception of the satellite broadcasting signal is considerably difficult to embody in practice. Furthermore, in the conventional flat antenna, the radiation element (rectangular patch) has a very narrow band resulting from the use of a single feeding manner, a mutual coupling occurs between the radiation elements and the feeding network and the feeding network is exposed over the substrate, resulting in an increase loss in reception.

SUMMARY OF THE INVENTION

The present invention has been made in view of the above problems, and it is an object of the present invention to provide a flat antenna wherein a band width of a reception frequency can be widened.

It is another object of the present invention to provide a flat antenna wherein a mutual coupling between radiation elements and a feeding network can be removed so that a reception efficiency can be increased.

In accordance with one aspect of the present invention, there is provided a flat antenna comprising: ground means; first insulating means formed on said ground means for electrical isolation; feeding means formed on said first insulating means; second insulating means formed on said feeding means for removal of a signal coupling between components; and radiation means formed on said second insulating means.

In accordance with another aspect of the present invention, there is provided a flat antenna comprising: ground means; first insulating means formed on said ground means for electrical isolation; receiving means formed on said first insulating means; second insulating means formed on said receiving means; and coupling removing means formed on said second insulating means for removal of a mutual coupling between components on said receiving means; wherein said ground means and said receiving means are electrically isolated from each other by said first insulating means and said receiving means and said coupling means are electrically isolated from each other by said second insulating means.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE PREFERRED EMBODIMENT

Figure 1:
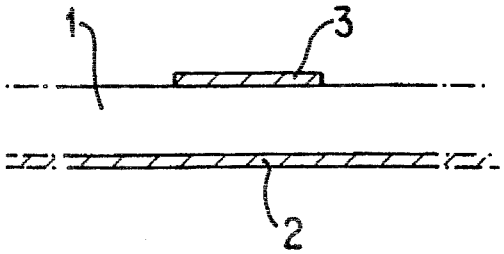
FIG.1 PRIOR ART
FIG. 1 is a view illustrating a basic construction of a conventional flat antenna.
Figure 2:
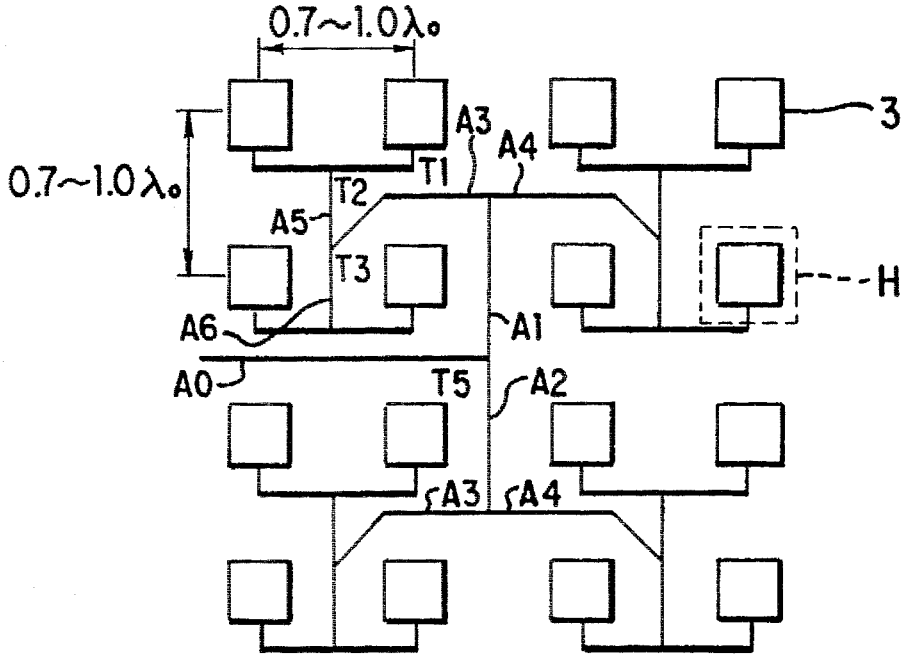
FIG.2 PRIOR ART
FIG. 2 is a plan view of the conventional flat antenna.
Figure 3:
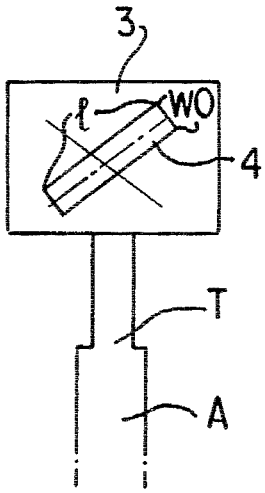
FIG. 3 PRIOR ART
FIG. 3 is a detailed diagram of a portion H in FIG. 2.
Figure 4:
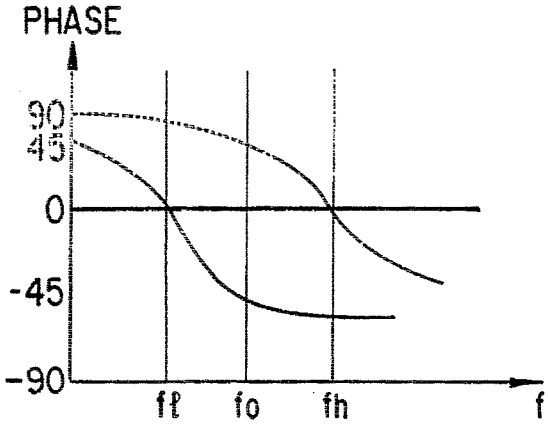
FIG.4 PRIOR ART
FIG. 4 is a graph illustrating a phase characteristic of a reception frequency in FIG. 3.
Figure 5:
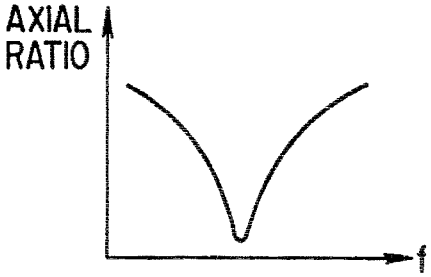
FIG.5 PRIOR ART
FIG. 5 is a graph illustrating a reception frequency characteristic with respect to an axial ratio in FIG. 3.
Figure 6:
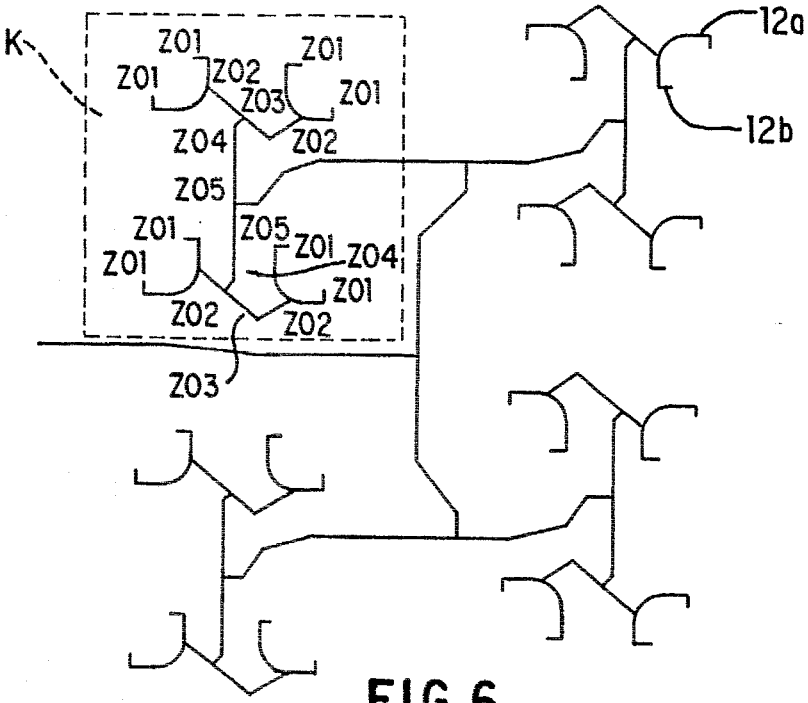
FIG. 6 is a view illustrating a dual feeding network of a flat antenna in accordance with the present invention.
Figure 7:
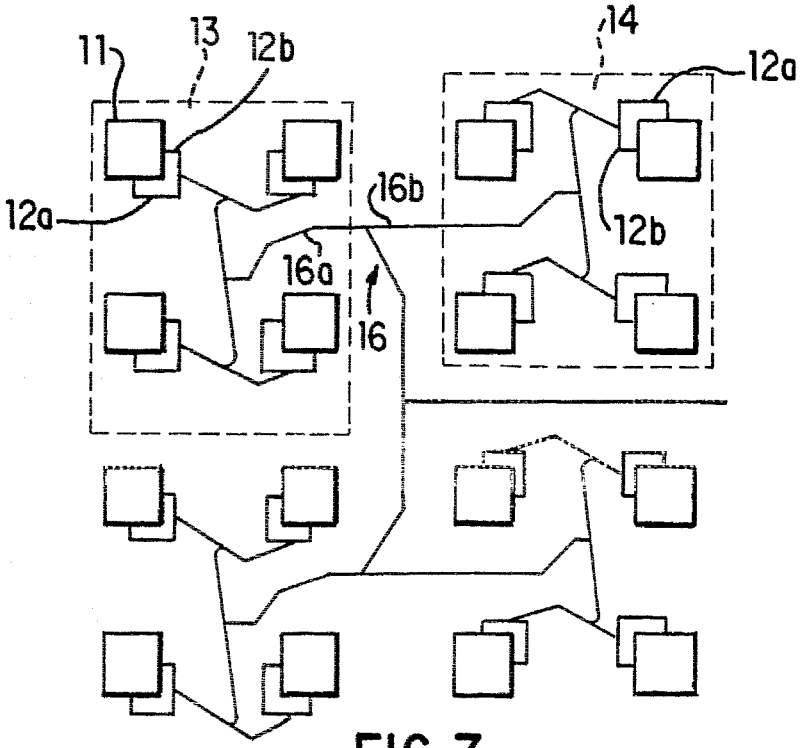
FIG. 7 is a plan view of the flat antenna in which is illustrated interconnections of patch units of the flat antenna with the dual feeding network in FIG. 6, according to the present invention.

FIG. 8 is a view illustrating a dual feeding network of a flat antenna in accordance with the present invention and FIG. 7 is a plan view of the flat antenna in which is illustrated interconnections of patch units of the flat antenna with the dual feeding network in FIG. 6, according to the present invention. As shown, the flat antenna of the present invention comprises a plurality of patch units 11, each having two feeding lines 12*a* and 12*b* connected thereto which have electrical lengths of λg/2 and λg/4, respectively, and are 90° out of phase. An antenna unit 13 is comprised of a set of 4 patch units 11 and an antenna unit 14 is comprised of another set of 4 patch units 11 corresponding to the antenna unit 13. Electrical lengths of transmission lines 16*a* and 16*b* to the antenna units 13 and 14 are determined to have a difference by λg/2 therebetween such that the antenna units 13 and 14 are in phase.

Figure 8A:
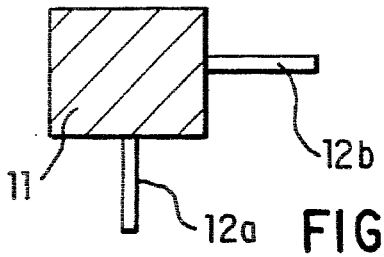
FIGS. 8A and 8B are views illustrating generation of a circular polarization by a dual feeding manner in use of rectangular patch units, according to the present invention.
Figure 8B:
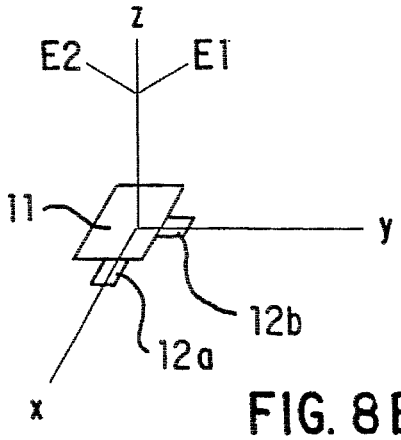

Generation of a circular polarization by a dual feeding manner of the planar antenna width the above-mentioned construction according to the present invention will hereinafter be described with reference to FIGS. 8A and 8B and 9A and 9B. The feeding lines 12*a* and 12*b* connected to the patch units 11 as shown in FIG. 8A have different lengths such that they are 90° out of phase in feeding power. For this reason, radiation fields E1 and E2 are generated at an angle of 90° with respect to each other in an orthogonal coordinates system as shown in FIG. 8B. The circular polarization is, therefore, generated by the resultant vector of the radiation fields E1 and E2.

Assuming that an input impedance of the patch unit 11 is Zin, a characteristic impedance is Zo and a load impedance is ZL and a feeding line length is 1, the following equation can be obtained:

$$ZIN=Zo.\{(jZo.\tan\beta 1)/(Zo+jZL.\tan\beta 1)\}$$

From the above equation, it can be understood that the feeding lines 12*a* and 12*b* have the lengths of λg/2 and λg/4, respectively, such that the radiation fields E1 and E2 are generated 90° out of phase.

Figure 9A:
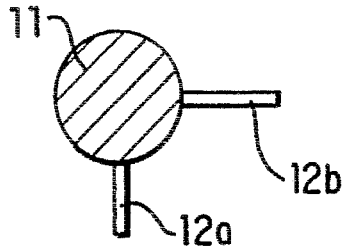
FIGS. 9A and 9B are views illustrating generation of the circular polarization by the dual feeding manner in use of circular patch units, according to the present invention.
Figure 9B:
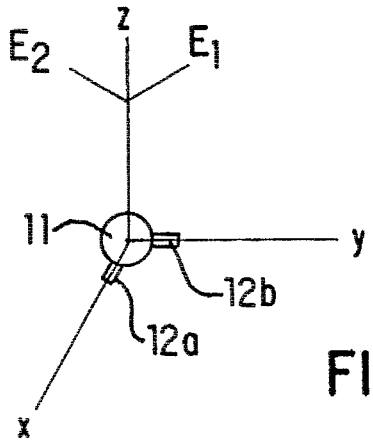

It should be noted that the present invention is applicable to the case where the patch units are circular as shown in FIGS. 9A and 9B as well as to the case where the patch units 11 are rectangular as shown in FIGS. 8A and 8B.

Figure 10:
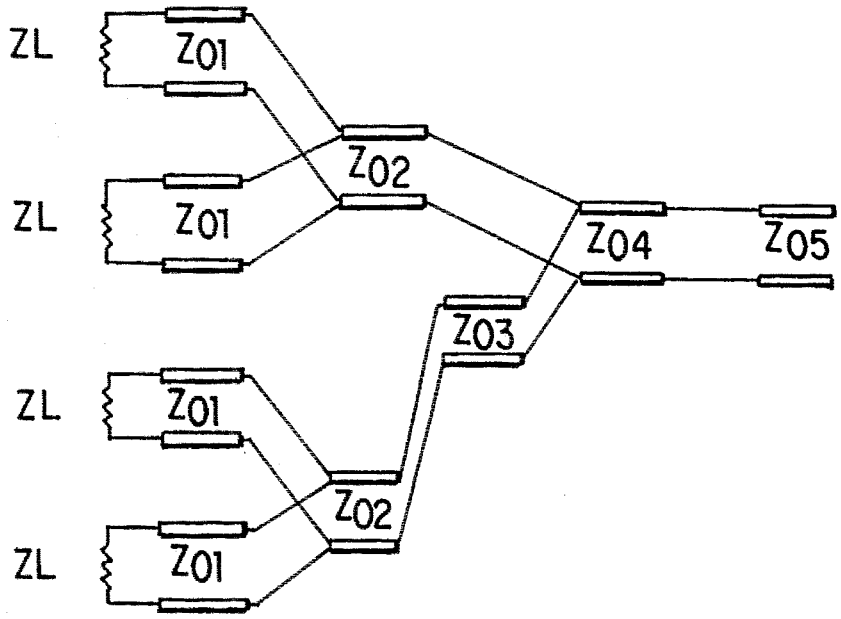
FIG. 10 is an equivalent circuit diagram of a portion K in FIG. 6.

Assuming that the impedances of the feeding lines in a portion K in FIG. 6 are respectively Zo1–Zo5, an equivalent circuit of the antenna units constituting the flat antenna of the present invention can be obtained as shown in FIG. 10. Also, a width W1 and a length L of the patch unit 11 are determined according to a center frequency. For example, in the case where a satellite broadcasting frequency is about 12 GHz, the width W1 and length L of the patch unit 11 can be determined through a numerical analysis.

Figure 11:
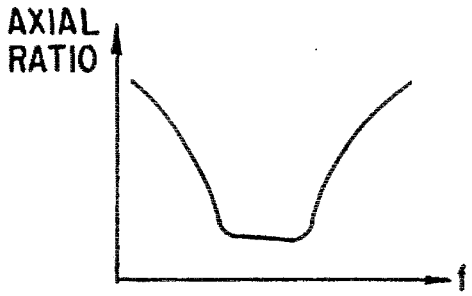
FIG. 11 is a graph illustrating a reception frequency characteristic with respect to an axial ratio in FIG. 7.

As mentioned above with reference to FIG. 7, in arranging the antenna unit 13 consisting of the set of 4 patch units 11 and the antenna unit 14 consisting of another set of 4 patch units 11, the electrical lengths of the transmission lines 16*a* and 16*b* of the transformer 16 connected respectively to the antenna units 13 and 14 are determined to have a difference by λg/2 therebetween. In this connection, arranging slot patterns of the patch units 11 in the antenna units 13 and 14 in the opposite directions enables reception characteristics of the antenna units 13 and 14 to be in phase. For this reason, a reception frequency characteristic can be widened as shown in FIG. 11.

Figure 12:
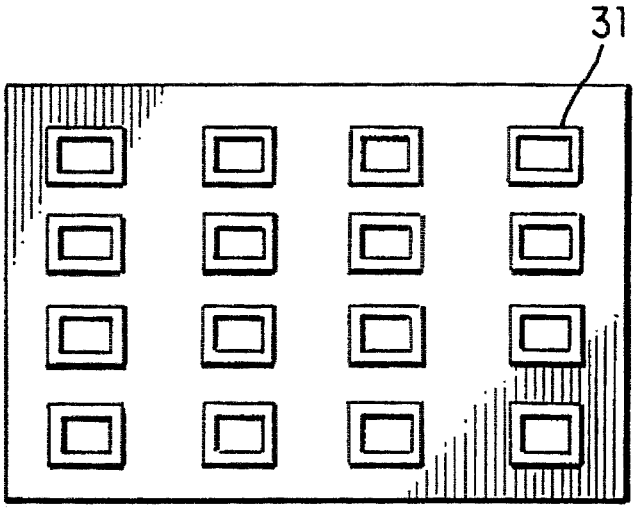
FIG. 12 is a plan view of a flat antenna of the dual feeding type which removes a mutual coupling between radiation elements and a feeding network in accordance with an embodiment of the present invention.
Figure 13:
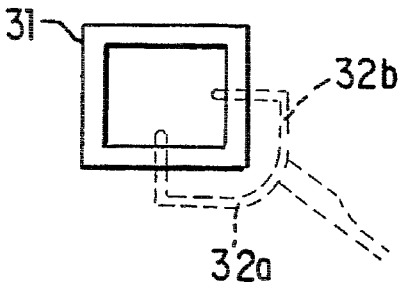
FIG. 13 is a view illustrating a basic construction of the flat antenna in FIG. 12.
Figure 14:
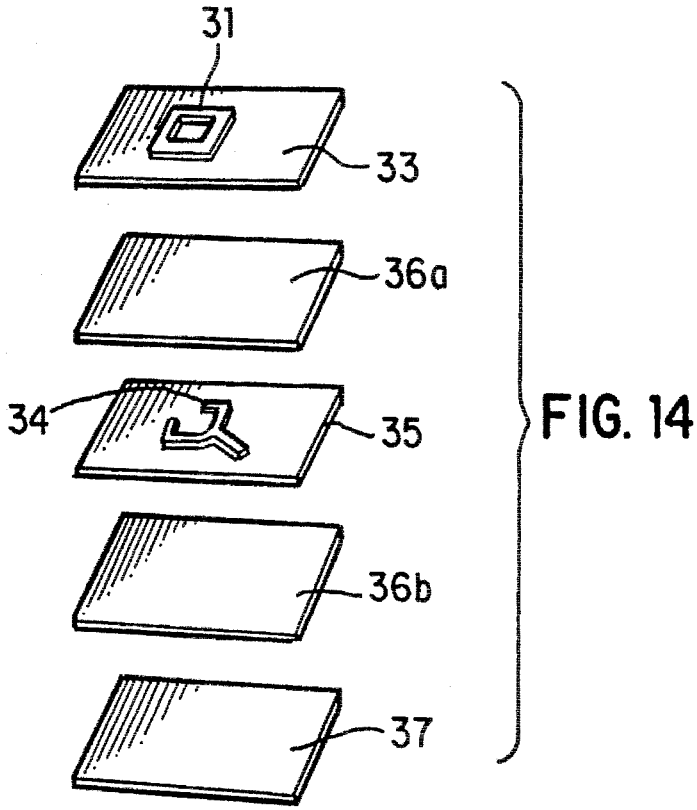
FIG. 14 is an exploded perspective view of the flat antenna in FIG. 12.

FIGS. 12 to 14 are views illustrating a signal coupling removing construction in accordance with an embodiment of the present invention. Herein, in FIG. 12, there is shown a 4*4 array flat antenna.

In FIG. 13, feeding lines 32*a* and 32*b* are formed under a radiation element 31, with the lengths thereof being λg/2 and λg/4, respectively, as mentioned above with reference to FIG. 7. In FIG. 14, a styrene foam substrate 36*a* is formed between a radiation element substrate 33 on which the radiation element 31 is formed and a feeding network substrate 35 on which a feeding network 34 is formed. Also, a styrene foam substrate 36*b* is formed between the feeding network substrate 35 and a ground substrate 37. These formations of the styrene foam substrates 36*a* and 36*b* allow an electromagnetic coupling between the radiation element 31 and the feeding network 34 in a constant space. The radiation element substrate 33, the insulating substrate (styrene foam substrate) 36*a*, the feeding network substrate 35, the insulating substrate (styrene foam substrate) 36*b* and the ground substrate 37 are stacked in order, to form a multi-layered structure.

Figure 15:
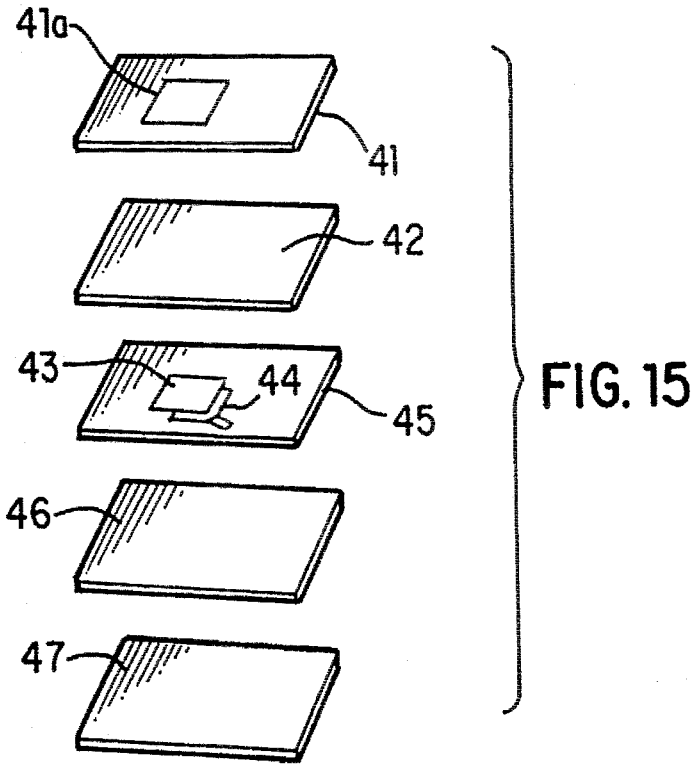
FIG. 15 is an exploded perspective view of a flat antenna of the dual feeding type which removes a mutual coupling between radiation elements and a feeding network in accordance with an alternative embodiment of the present invention.

Referring to FIG. 15, there is shown a signal coupling removing construction in accordance with an alternative embodiment of the present invention. As shown in this figure, a styrene foam substrate 42 is formed between a slot substrate 41 on which a slot 41*a* is formed and a substrate 45 on which a radiation element 43 and a feeding network 44 are formed, and a styrene foam substrate 46 is formed between the substrate 45 and a ground substrate 47. The slot substrate 41, the insulating substrate (styrene foam substrate) 42, the radiation element and feeding network formed substrate 45, the insulating substrate (styrene foam substrate) 46 and the ground substrate 47 are stacked in order to form a multi-layered structure.

Since the styrene foam substrates have a dielectric constant approximate to that of air, there can nearly be removed a loss due to the electrical transfer operation between the components and the electrical signal coupling therebetween. The styrene foam substrates each has thickness of, preferably, 1.8 to 2 mm.

Figure 16:
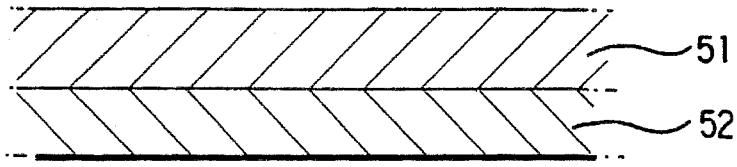
FIG. 16 is a sectional view of a thin film which is used in accordance with the present invention.

The radiation element substrate 33 and the feeding network substrate 35 in FIG. 14 and the slot substrate 41 and the radiation element and feeding network formed substrate 45 in FIG. 15 each is formed by photoetching a thin film as shown in FIG. 16. The thin film may a low cost film which includes an aluminum 51 of a thickness of 10 to 20 microns and a polyethylene terephtalate 52 of a thickness of 15 to 100 microns, both of which adhere to the film, as shown in FIG. 16.

Figure 17A:
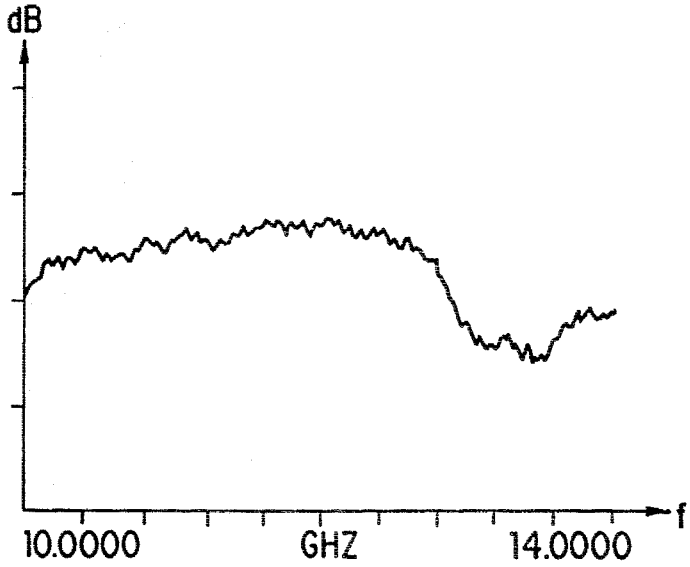
FIG. 17A is a graph illustrating a band width of a reception frequency of the flat antenna according to the present invention.
Figure 17B:
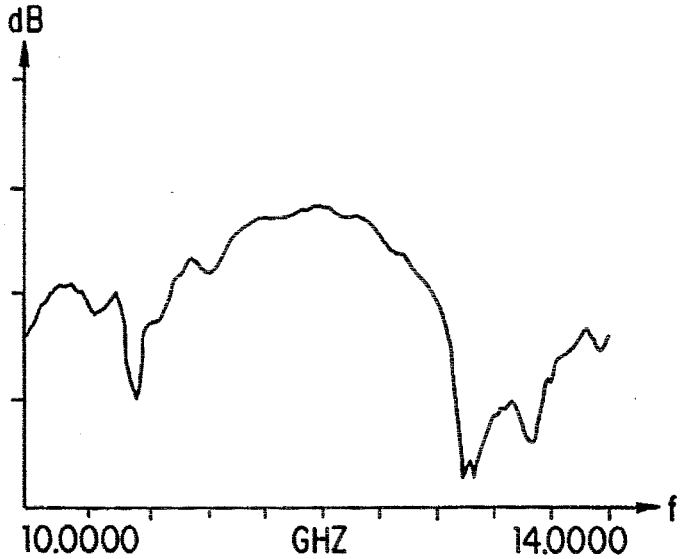
FIG. 17B is a graph illustrating a band width of a reception frequency of the conventional flat antenna.

In accordance with the planar antenna of the present invention, there can be obtained the band width of the reception frequency as shown in FIG. 17A much wider than that of the prior art as shown in FIG. 17B. Also, although the present invention has been applied to the case where the slot 41*a* is rectangular, those skilled in the art will appreciate that it is applicable even to the case where the slot 41*a* is circular, resulting in the same effect. Similarly in this case, the size of the slot 41*a* is about λg/2.

As hereinbefore described, according to the present invention, the flat antenna comprises the antenna units, each consisting of the 4 patch units. In arranging the two antenna units corresponding to each other in the antenna units, the electrical lengths of the transmission lines connected respectively to the corresponding two antenna units are determined to have a difference by λg/2 therebetween. In this connection, arranging the slot patterns of the patch units in the two corresponding antenna units in the opposite directions enables the reception characteristics of the two corresponding antenna units to be in phase. This has the effect of widening. the reception frequency characteristic. Also, the antenna body in which a multiplicity of antenna units are integrated has the multi-layered structure to prevent an undesired radiation and to remove the signal coupling between the components, resulting in an increase in universalization and reliability of the whole reception characteristic of the antenna. Particularly when the present invention is applied to the satellite broadcasting field, the reception of the satellite broadcasting signal is enabled over the wide frequency region from the ultra high frequency (UHF) band to the super high frequency (SHF) band.

Although the preferred embodiments of the present invention have been disclosed for illustrative purpose, those skilled in the art will appreciate that various modifications, additions and substitutions are possible, without departing from the scope and spirit of the invention as disclosed in the accompanying claims.

What is claimed is:

1. A flat antenna of a dual feeding type comprising first and second antenna units, each of said first and second antenna units comprising:

(1) a ground substrate;

(2) first insulating means formed on said ground substrate for electrical isolation of said ground substrate;

(3) receiving means formed on said first insulating means for receiving a transmission;

(4) a second insulator formed on said receiving means; and (5) coupling removing means formed on said second insulator and having a slot positioned in vertical upward direction of said radiation elements for removal of a mutual coupling between components on said receiving means;

wherein said ground substrate and said receiving means are electrically isolated from each other by said first insulating means and said receiving means and said coupling means are electrically isolated from each other by said second insulator; and wherein said receiving means includes:

(a) a plurality of radiation elements;

(b) a plurality of first pairs of feeding lines, each of said first pairs of feeding lines being connected to a respective one of said radiation elements with the lines of each of said first pairs of feeding lines having different electrical lengths to have a phase difference of 90°; each one of the radiation elements and a respective one of said first pairs of feeding lines defining a patch unit; and (c) a substrate on which said radiation elements and said first pairs of feeding lines are formed; and another pair of feeding lines connected to said first and second antenna units, said another pair of feeding lines having different electrical lengths to provide a phase difference of 180°; the plurality of patch units in said second antenna unit being arranged in a direction opposite to the direction of the plurality of patch units in said first antenna unit; whereby reception characteristics of said first and second antenna units are in phase.

2. A flat antenna as set forth in claim 1 wherein each of said first and second antenna units comprise four patch units.

3. A flat antenna as set forth in claim 2 further comprising third and fourth antenna units having the same structural arrangement as said first and second antenna units with the another pair of feeding lines of each of said first and second antenna units and of said third and fourth antenna units being branches of a main feeding line.

4. A flat antenna as set forth in claim 3 wherein each of said radiation elements are rectangular.

5. A flat antenna as set forth in claim 4 wherein each of said slots are rectangular.

* * * * *